US010612488B2

(12) United States Patent
Choi

(10) Patent No.: US 10,612,488 B2
(45) Date of Patent: Apr. 7, 2020

(54) FUEL INJECTOR AND METHOD FOR CONTROLLING THE SAME

(71) Applicants: HYUNDAI MOTOR COMPANY, Seoul (KR); KIA MOTORS CORPORATION, Seoul (KR)

(72) Inventor: Chang Yeol Choi, Suwon-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 231 days.

(21) Appl. No.: 15/830,695

(22) Filed: Dec. 4, 2017

(65) Prior Publication Data

US 2019/0120162 A1 Apr. 25, 2019

(30) Foreign Application Priority Data

Oct. 24, 2017 (KR) ..... 10-2017-0138583

(51) Int. Cl.

| | |
|---|---|
| ***F02D 41/30*** | (2006.01) |
| ***F02D 41/38*** | (2006.01) |
| ***F02M 51/06*** | (2006.01) |
| ***F02M 61/10*** | (2006.01) |
| *F02D 41/20* | (2006.01) |
| *F02M 47/02* | (2006.01) |

(52) U.S. Cl.

CPC ..... *F02D 41/3017* (2013.01); *F02D 41/38* (2013.01); *F02D 41/3872* (2013.01); *F02M 51/0625* (2013.01); *F02M 51/0639* (2013.01); *F02M 61/10* (2013.01); *F02D 41/2096* (2013.01); *F02D 2200/10* (2013.01); *F02M 47/027* (2013.01)

(58) Field of Classification Search

CPC ..... F02D 41/2096; F02D 41/3017; F02D 41/3836; F02D 41/3863; F02D 41/3872; F02D 45/00; F02D 2200/10; F02M 51/0639; F02M 51/0642; F02M 51/0653

See application file for complete search history.

(56) References Cited

U.S. PATENT DOCUMENTS

| | | | | |
|---|---|---|---|---|
| 5,048,489 A * | 9/1991 | Fischer | F02M 47/043 | 123/467 |
| 5,758,865 A * | 6/1998 | Casey | F02M 51/0639 | 251/129.17 |
| 6,027,037 A * | 2/2000 | Murakami | F02D 41/3827 | 239/533.8 |
| 6,047,948 A * | 4/2000 | Hasegawa | F02M 51/0653 | 251/129.18 |

(Continued)

*Primary Examiner* — Ryan A Reis

(74) *Attorney, Agent, or Firm* — Morgan, Lewis & Bockius LLP

(57) ABSTRACT

A fuel injector for a combustion engine is disclosed. The fuel injector includes an injector body having a nozzle orifice, a solenoid coil mounted in the injector body, a control chamber filled with high-pressure fuel, an armature moved by electromagnetic force of the solenoid coil to vary fuel pressure in the control chamber, and a needle that moves to open or close the nozzle orifice according to the variation in the fuel pressure in the control chamber. The fuel injector further includes piezoelectric actuator for adjusting a fuel injection rate by adjusting an opening speed of the nozzle orifice based on a load condition of the engine.

14 Claims, 6 Drawing Sheets

(56) References Cited

U.S. PATENT DOCUMENTS

| | | | | |
|---|---|---|---|---|
| 6,354,276 | B1 * | 3/2002 | Toiyama | F02M 61/168<br>123/472 |
| 2006/0138374 | A1 * | 6/2006 | Lucas | F02M 47/027<br>251/129.16 |
| 2007/0284456 | A1 * | 12/2007 | Tsuchiya | F02M 51/0603<br>239/102.2 |
| 2018/0003124 | A1 * | 1/2018 | Ikemoto | F02D 41/3836 |

* cited by examiner

FUEL INJECTOR AND METHOD FOR CONTROLLING THE SAME

CROSS-REFERENCE TO RELATED APPLICATION

This application is based on and claims the benefit of priority to Korean Patent Application No. 10-2017-0138583, filed on Oct. 24, 2017, in the Korean Intellectual Property Office, the disclosure of which is incorporated herein in its entirety by reference.

TECHNICAL FIELD

The present disclosure relates to a fuel injector. More specifically, the present disclosure relates to a fuel injector and a control method thereof for adjusting a fuel injection rate and the amount of fuel to be injected, based on a load condition of a vehicle.

BACKGROUND

A common rail fuel injection system for directly injecting fuel into a combustion chamber of an engine is configured to compress fuel supplied from a fuel tank to a high pressure, accumulate the high-pressure fuel in a common rail, and inject the fuel accumulated in the common rail into a combustion chamber through fuel injectors.

The common rail fuel injection system has a plurality of fuel injectors installed to correspond to respective cylinders of an engine, a common rail for accumulating fuel to maintain a relatively high target rail pressure, a high-pressure pump for pressurizing fuel suctioned from a fuel tank through a low-pressure feed pump to a high pressure and then supplying the high-pressure fuel into the common rail, and a controller for controlling the fuel injectors and the high-pressure pump.

The fuel injectors are fuel injection devices mounted in an engine cylinder head of a vehicle to inject fuel into a combustion chamber. Examples of the fuel injectors include a solenoid injector, a piezoelectric injector, and the like.

The disclosure of this section is to provide background of the invention. Applicant notes that this section may contain information available before this application. However, by providing this section, Applicant does not admit that any information contained in this section constitutes prior art.

SUMMARY

A solenoid injector includes an injector body, a solenoid coil mounted in the injector body, an armature vertically movable by electromagnetic force of the solenoid coil, and a needle vertically moving together with the armature to open or close nozzle orifices of the injector body.

Meanwhile, a solenoid injector in the related art has a constant fuel injection rate irrespective of a load condition of a vehicle since an armature of the solenoid injector has a specified vertical moving distance. Due to this, the solenoid injector cannot adjust a fuel injection rate based on a load condition of a vehicle and therefore has difficulty in appropriately responding to gradually increased emission regulations.

The present disclosure has been made to solve the above-mentioned problems occurring in the related art while advantages achieved by the related art are maintained intact.

An aspect of the present disclosure provides a fuel injector and a control method thereof for adjusting a fuel injection rate based on a load condition of an engine to improve output performance or satisfy emission regulations.

The technical problems to be solved by the present disclosure are not limited to the aforementioned problems, and any other technical problems not mentioned herein will be clearly understood from the following description by those skilled in the art to which the present disclosure pertains.

An aspect of the present invention discloses a combustion engine including a fuel injector 10 for spraying particulate fuel into a cylinder chamber. The fuel injector 10 is configured to control amount of fuel injection per single spraying action (per single operation of opening the nozzle orifices 11*a*) using a piezoelectric actuator 55 for adjusting stroke of the amateur 13. In embodiments, the longer stroke of amateur 13, the faster lifting speed of the control rod 16 and the needle 15, the more amount of fuel injection per single spraying action (single lifting of needle).

In embodiments, when a driver is pressing an accelerator pedal to a full throttle position (seeking a full acceleration or torque), the controller does not actuate (or actuate at a minimum degree) the piezoelectric actuator 55 to maintain thickness of the piezoelectric actuator 55 at a minimum thickness P1. Accordingly, stroke of the amateur 13 is maintained at a maximum length T1 (greater than T2) such that instant pressure drop in the control chamber 14 according to a single lifting of the amateur 13 is maintained at a first (maximum) level to have a first (maximum) fuel injection amount per single activation of the solenoid coil 12.

In embodiments, when a driver is pressing the accelerator pedal to a partial throttle position other than the full throttle position (seeking an acceleration or torque less than the full acceleration or torque), the controller activates the piezoelectric actuator 55 to maintain thickness of the piezoelectric actuator 55 at a thickness P2 thicker than P1. Accordingly, pressure drop in the control chamber 14 according to a single lifting of the amateur 13 is maintained at a second level less than the first level. Also, amount of fuel injection per single activation of the solenoid coil 12 is less than the first fuel injection amount According to an aspect of the present disclosure, a fuel injector includes an injector body having a nozzle orifice, a solenoid coil mounted in the injector body, a control chamber filled with high-pressure fuel, an armature moved by electromagnetic force of the solenoid coil to vary fuel pressure in the control chamber, a needle that moves to open or close the nozzle orifice according to the variation in the fuel pressure in the control chamber, and an adjustment unit that adjusts a fuel injection rate by adjusting an opening rate shape slope of the nozzle orifice based on a load condition of an engine.

The adjustment unit may adjust the opening rate shape slope (opening speed) of the nozzle orifice by varying a reduction rate of the fuel pressure in the control chamber based on the load condition of the engine when the needle opens the nozzle orifice.

The adjustment unit may adjust the opening rate shape slope (opening speed) of the nozzle orifice by adjusting the amount of fuel drained from the control chamber based on the load condition of the engine when the needle opens the nozzle orifice.

The adjustment unit may include a piezoelectric actuator interposed between the solenoid coil and the armature.

The piezoelectric actuator may contract to a minimum thickness if the piezoelectric actuator is de-energized. The piezoelectric actuator may expand if the piezoelectric actuator is energized. A thickness by which the piezoelectric actuator expands may be adjusted depending on the magnitude of applied input voltage.

An insulation layer may be coated on an outer surface of the piezoelectric actuator.

An insulator may be interposed between the solenoid coil and the piezoelectric actuator.

The injector body may have a high-pressure fuel passage communicating with the nozzle orifice. A drain chamber may be disposed between the solenoid coil and the control chamber. The control chamber may have an inlet passage communicating with the high-pressure fuel passage and an outlet passage communicating with the drain chamber. The armature may have a valve part configured to open or close an opening of the outlet passage.

A seat portion may be formed around the opening of the outlet passage. A lower end surface of the valve part and the seat portion may be spaced apart from, or brought into contact with, each other to open or close the outlet passage.

The lower end surface of the valve part and the seat portion may be spaced apart from each other by an opening gap when the armature moves upward. The opening gap may be adjusted according to contraction or expansion of the piezoelectric actuator.

The opening gap may be adjusted to be greater or smaller than a fixed gap of an outlet orifice according to contraction or expansion of the piezoelectric actuator.

The control chamber may be formed by a valve block, and the valve block may be mounted in the injector body and may be spaced apart downward from the solenoid coil.

The valve block may have a first sleeve extending downward and a second sleeve extending upward. The control chamber may be formed inside the first sleeve, and an inner drain chamber may be formed inside the second sleeve.

According to another aspect of the present disclosure, provided is a method of controlling a fuel injector that includes an injector body having a nozzle orifice, a solenoid coil mounted in the injector body, a control chamber filled with high-pressure fuel and having an inlet passage through which the high-pressure fuel is introduced and an outlet passage through which the high-pressure fuel is drained and that has an outlet orifice formed inside, an armature configured to be moved by electromagnetic force of the solenoid coil to vary fuel pressure in the control chamber, a needle configured to move to open or close the nozzle orifice according to the variation in the fuel pressure in the control chamber, and a piezoelectric actuator interposed between the solenoid coil and the armature. The method includes contracting the piezoelectric actuator to a minimum thickness under a full load condition of an engine and expanding the piezoelectric actuator to a predetermined expansion thickness under a partial load condition of the engine.

An opening gap may become larger than a fixed gap of the outlet orifice according to contraction of the piezoelectric actuator under the full load condition of the engine.

An opening gap may become smaller than or equal to a fixed gap of the outlet orifice according to expansion of the piezoelectric actuator under the partial load condition of the engine.

A thickness by which the piezoelectric actuator expands may be adjusted depending on the magnitude of applied voltage.

According to the present disclosure, by changing a variation in fuel pressure in a control chamber based on a load condition of an engine, it is possible to adjust a fuel injection rate, thereby improving output performance under a full load condition of the engine and satisfying emission regulations under a partial load condition of the engine.

According to embodiments of the present disclosure, under the full load condition of the engine, a piezoelectric actuator may contract to a minimum thickness, and therefore an opening gap may be greater than a fixed gap of an outlet orifice, which results in an increase in the amount of high-pressure fuel drained from the control chamber. Accordingly, a variation rate (reduction rate) of the fuel pressure in the control chamber may relatively increase so that a nozzle orifice may be rapidly opened. That is, the opening rate shape slope of the nozzle orifice may increase. As the opening rate shape slope of the nozzle orifice increases, an initial fuel injection rate and the amount of fuel to be injected may increase, and thus output performance may be improved.

According to the present disclosure, under the partial load condition of the engine, an expansion thickness of the piezoelectric actuator may be adjusted depending on the magnitude of voltage, and the opening gap may be smaller than the fixed gap of the outlet orifice, which results in a decrease in the amount of high-pressure fuel drained from the control chamber. Accordingly, a variation (reduction rate) of the fuel pressure in the control chamber may relatively decrease so that the nozzle orifice may be slowly opened. That is, the opening rate shape slope of the nozzle orifice may decrease. As the opening rate shape slope of the nozzle orifice decreases, an initial fuel injection rate and the amount of fuel to be injected may decrease. As a result, NOx may be reduced, and thus emission regulations may be assuredly satisfied.

BRIEF DESCRIPTION OF THE DRAWINGS

The above and other objects, features and advantages of the present disclosure will be more apparent from the following detailed description taken in conjunction with the accompanying drawings:

FIG. 2 illustrates a state in which an outlet passage of a control chamber is closed;

DETAILED DESCRIPTION

Figure 1:
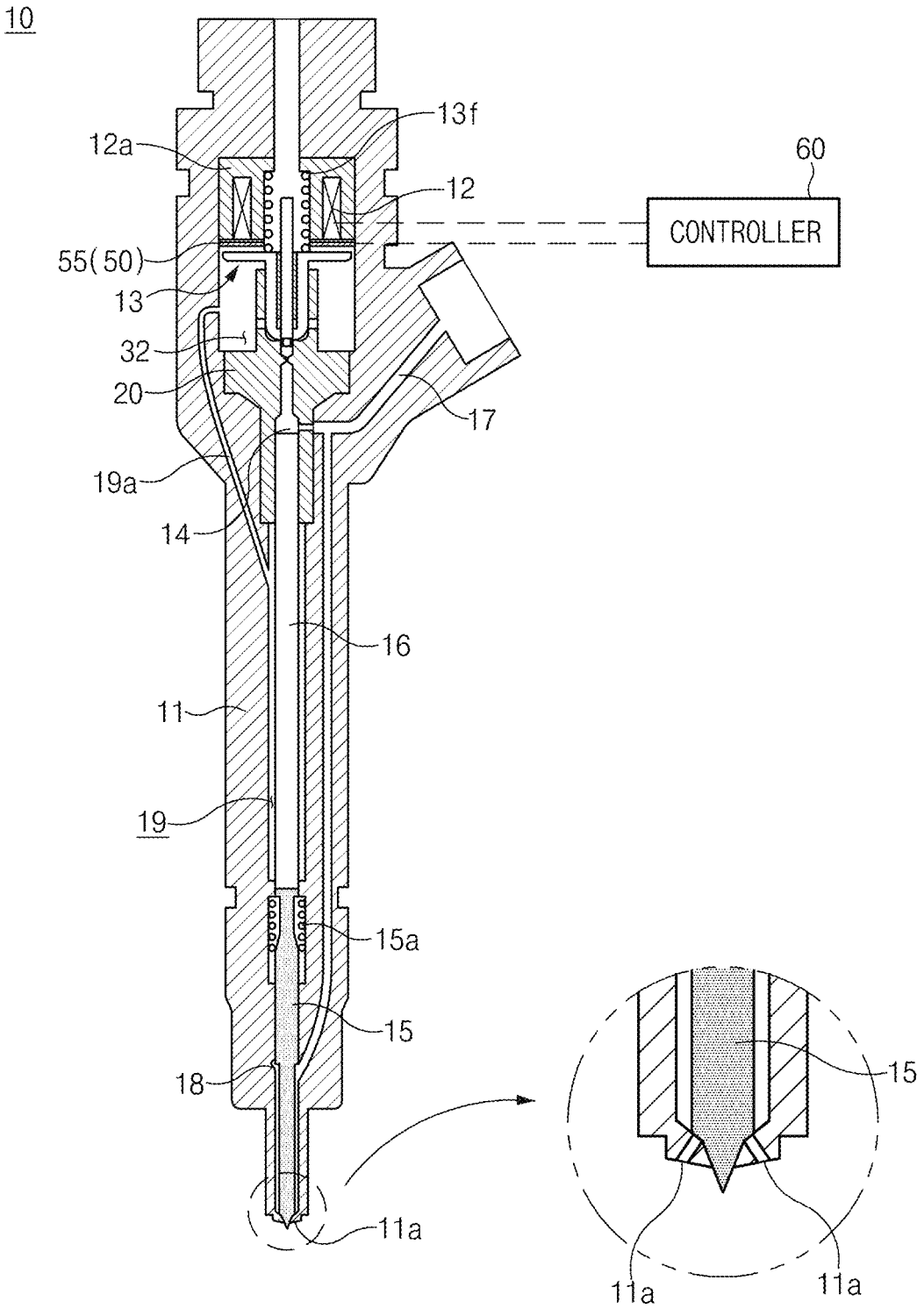
FIG. 1 is a sectional view of a fuel injector according to an embodiment of the present disclosure.

Hereinafter, embodiments of the present disclosure will be described in detail with reference to the accompanying drawings. In the drawings, the same reference numbers will be used throughout to designate the same or equivalent elements. In addition, a detailed description of well-known features or functions will be ruled out in order not to unnecessarily obscure the gist of the present disclosure.

Terms, such as "first", "second", "A", "B", "(a)", "(b)", and the like, may be used herein to describe elements of the present disclosure. Such terms are only used to distinguish one element from another element, and the substance, sequence, order, or number of these elements is not limited by these terms. Unless otherwise defined, all terms used herein, including technical and scientific terms, have the same meaning as those generally understood by those skilled in the art to which the present disclosure pertains. Such terms as those defined in a generally used dictionary are to be interpreted as having meanings equal to the contextual meanings in the relevant field of art, and are not to be interpreted as having ideal or excessively formal meanings unless clearly defined as having such in the present application.

Figure 2:
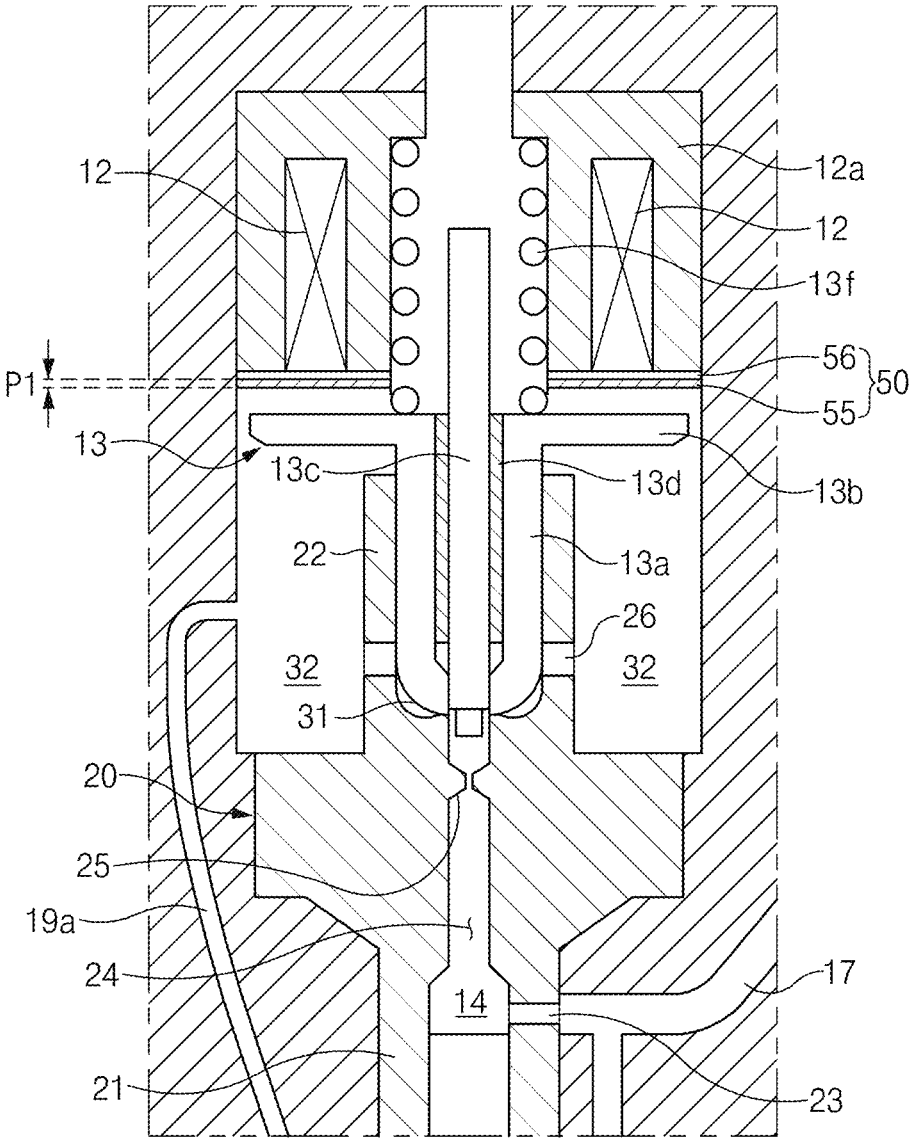
FIG. 2 is a blowup of an upper portion of FIG. 1, where
Figure 3:
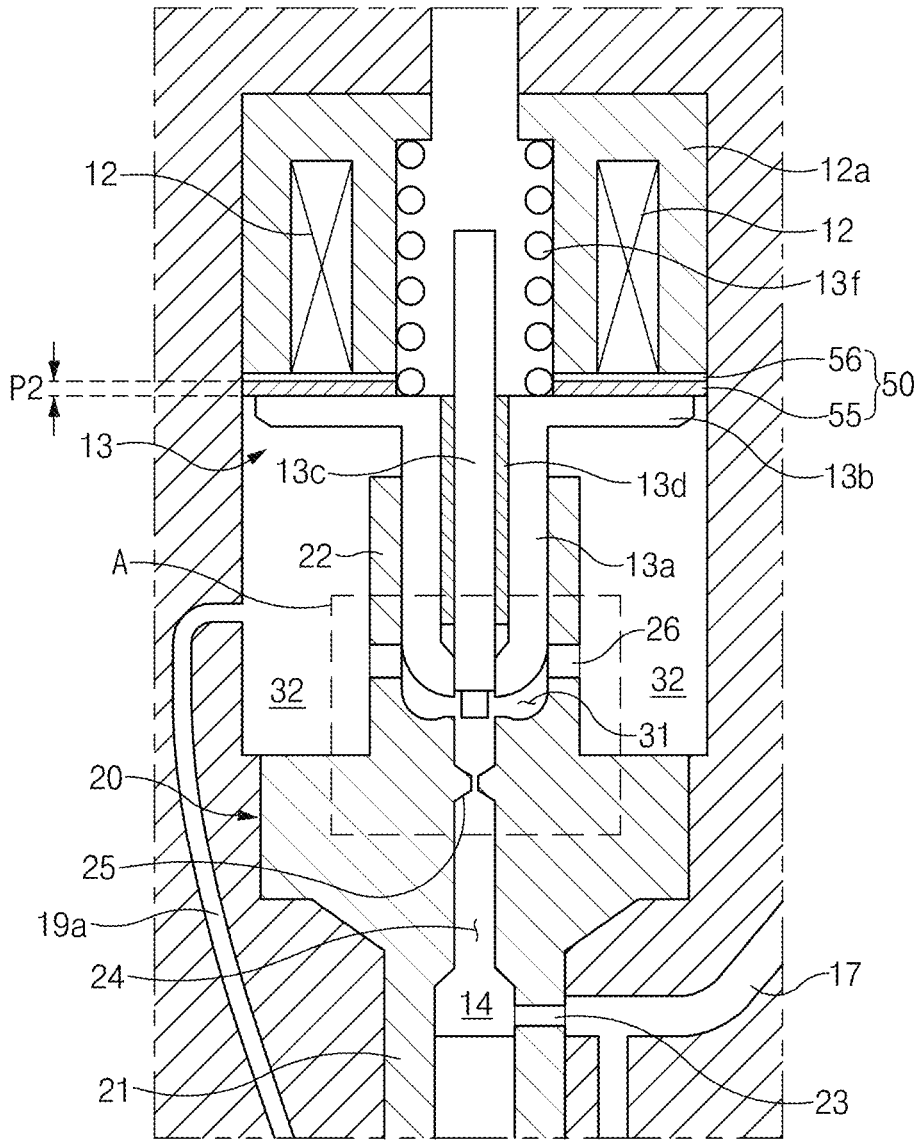
FIG. 3 illustrates a state in which the outlet passage of the control chamber illustrated in FIG. 2 is closed.
Figure 4:
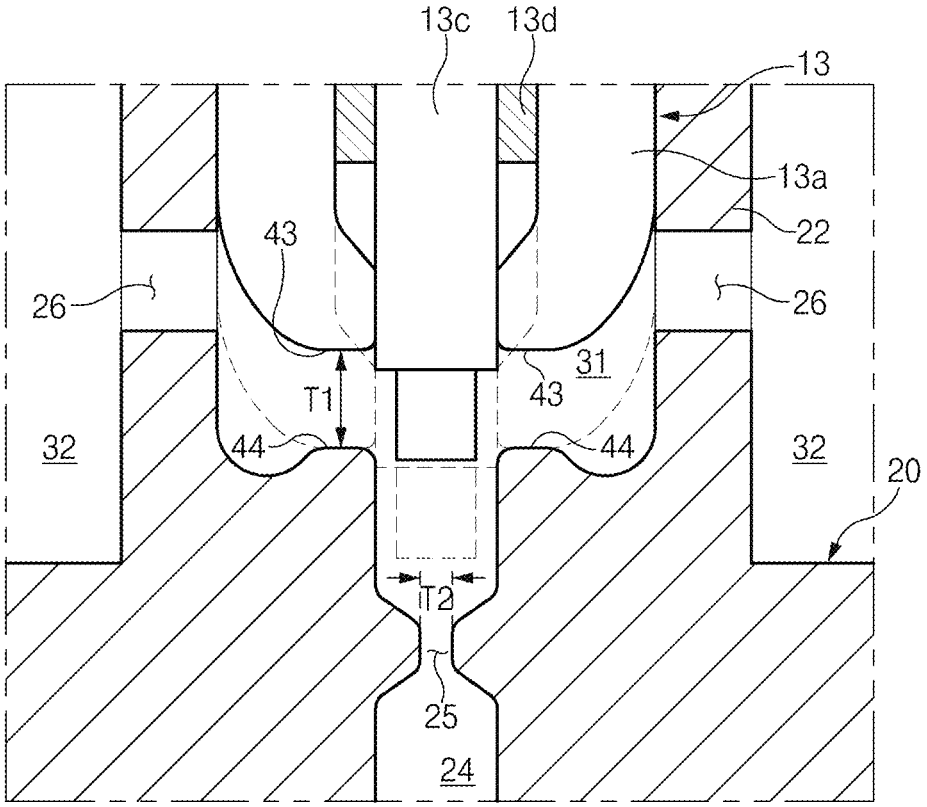
FIG. 4 is a blowup of detail A in FIG. 3.

Referring to FIGS. 1 to 3, a fuel injector 10 according to an embodiment of the present disclosure may include an injector body 11, a solenoid coil 12 mounted in the injector body 11, an armature 13 movable by electromagnetic force of the solenoid coil 12, a control chamber 14 formed below the armature 13, and a needle 15 moving between an open position and a closed position according to a variation in fuel pressure in the control chamber 14.

The injector body 11 may have one or more nozzle orifices 11*a*. The nozzle orifices 11*a* may be formed at a lower end of the injector body 11. The nozzle orifices 11*a* may be opened or closed by a vertical movement of the needle 15. A control rod 16 may be connected to an upper end of the needle 15. The control rod 16 may move upward or downward according to a variation in fuel pressure in the control chamber 14. The control rod 16 and the needle 15 may move upward or downward together. The needle 15 may move between the closed position at which the needle 15 closes the nozzle orifices 11*a* and the open position at which the needle 15 opens the nozzle orifices 11*a*.

A high-pressure fuel passage 17, a nozzle chamber 18, and a middle chamber 19 may be formed inside the injector body 11.

The high-pressure fuel passage 17 may be connected to a common rail and may receive high-pressure fuel from the common rail. The high-pressure fuel passage 17 may communicate with the control chamber 14, and therefore the control chamber 14 may be filled with the high-pressure fuel. The high-pressure fuel passage 17 may communicate with the nozzle chamber 18, and therefore the nozzle chamber 18 may be filled with the high-pressure fuel.

The nozzle chamber 18 may be formed in a lower part of the injector body 11. The nozzle chamber 18 may communicate with the nozzle orifices 11*a*.

The needle 15 may move upward or downward in the nozzle chamber 18. The needle 15 may move between the open position at which the needle 15 opens the nozzle orifices 11*a* and the closed position at which the needle 15 closes the nozzle orifices 11*a*. A spring 15*a* may be mounted on the needle 15. The spring 15*a* may be configured to urge the needle 15 downward.

The middle chamber 19 may extend long in a middle part of the injector body 11, and the control rod 16 may move upward or downward in the middle chamber 19.

The solenoid coil 12 may be mounted in the injector body 11. The solenoid coil 12 may be mounted in an upper part of the injector body 11 through a coil bobbin 12*a*. A spring 13*f* may be disposed in a hollow portion of the coil bobbin 12*a* to urge the armature 13 downward.

The armature 13 may be disposed below the solenoid coil 12 so as to be adjacent to the solenoid coil 12. The armature 13 may have a valve part 13*a* and a disk part 13*b* formed on an upper end of the valve part 13*a*.

A shaft 13*c* may be mounted in a hollow portion of the valve part 13*a* through a busing 13*d*. A lower end of the spring 13*f* may make contact with an upper surface of the disk part 13*d*, and therefore the armature 13 may be moved downward by spring force of the spring 13*f*.

The control chamber 14 may be formed below the armature 13, and fuel pressure in the control chamber 14 may be varied depending on a movement of the armature 13. The control chamber 14 may have an inlet passage 23 and an outlet passage 24. The inlet passage 23 may communicate with the high-pressure fuel passage 17, and the outlet passage 24 may communicate with an inner drain chamber 31. The high-pressure fuel may flow into the control chamber 14 from the high-pressure fuel passage 17 through the inlet passage 23, and the control chamber 14 may be filled with the high-pressure fuel.

If the armature 13 moves upward to allow the valve part 13*a* of the armature 13 to open the outlet passage 24 of the control chamber 14, the high-pressure fuel may be drained from the control chamber 14 to the inner drain chamber 31 through the outlet passage 24, and thus the fuel pressure in the control chamber 14 may decrease. If the armature 13 moves downward to allow the valve part 13*a* of the armature 13 to close the outlet passage 24 of the control chamber 14, high-pressure fuel may be introduced into the control chamber 14 through the inlet passage 23, and thus the fuel pressure in the control chamber 14 may increase. The variation in the fuel pressure in the control chamber 14 may cause an imbalance in force exerted on the control rod 16 and the needle 15. Accordingly, the control rod 16 and the needle 15 may move upward or downward, and the needle 15 may open or close the nozzle orifices 11*a*.

The control chamber 14 may be formed by a valve block 20. The valve block 20 may be mounted in the injector body 11. The valve block 20 may be spaced apart downward from the solenoid coil 12.

The valve block 20 may have a first sleeve 21 extending downward and a second sleeve 22 extending upward.

The first sleeve 21 may have the control chamber 14 and the inlet passage 23 formed therein, and the inlet passage 23 may be configured to communicate with the high-pressure fuel passage 17. An upper end of the control rod 16 may slide in the first sleeve 21, and therefore the control chamber 14 may be defined by the first sleeve 21 and the control rod 16.

Drain chambers 31 and 32 may be located between the control chamber 14 and the solenoid coil 12. The drain chambers 31 and 32 may be formed by the second sleeve 22 of the valve block 20 and a cavity of the injector body 11.

The inner drain chamber 31 may be formed in the second sleeve 22, and the outlet passage 24 may be formed in the valve block 20. The valve part 13*a* of the armature 13 may slide in the second sleeve 22, and therefore the inner drain chamber 31 may be defined by the second sleeve 22 and the valve part 13*a*.

The control chamber 14 and the inner drain chamber 31 may communicate with each other through the outlet passage 24, and an outlet orifice 25 may be formed in the outlet passage 24. The outlet orifice 25 may have a fixed gap T2.

The outer drain chamber 32 may be formed outside the second sleeve 22. The outer drain chamber 32 may be defined by the second sleeve 22 and a cavity of the injector body 11. A drain passage 26 may be formed in the second sleeve 22, and the inner drain chamber 31 and the outer drain chamber 32 may communicate with each other through the drain passage 26. Furthermore, the outer drain chamber 32 may communicate with the middle chamber 19 through a connecting passage 19*a*.

A seat portion 44 may be formed around an upper opening of the outlet passage 24. The seat portion 44 and/or a lower end surface 43 of the valve part 13*a* may be formed to be flat. The lower end surface 43 of the valve part 13*a* may be brought into contact with, or spaced apart from, the seat portion 44 by a movement of the armature 13 to close or open the outlet passage 24.

If the solenoid coil 12 is energized, the armature 13 may be attracted upward toward the solenoid coil 12 by electromagnetic force of the solenoid coil 12. At this time, the electromagnetic force of the solenoid coil 12 may overcome the spring force of the spring 13*f*. The lower end surface 43 of the valve part 13*a* may be spaced apart from the seat portion 44 by the upward movement of the armature 13 to open the outlet passage 24. The high-pressure fuel may be drained from the control chamber 14 to the inner drain chamber 31 by the opening of the outlet passage 24, and the fuel pressure in the control chamber 14 may relatively decrease. Accordingly, the fuel pressure in the control chamber 14 may be lower than that in the nozzle chamber 18. A force to push the needle 15 upward may be generated by the difference between the fuel pressure in the nozzle chamber 18 and the fuel pressure in the control chamber 14, and the needle 15, together with the control rod 16, may be moved upward by the force. Accordingly, the needle 15 may open the nozzle orifices 11*a*, and thus the high-pressure fuel may be injected through the nozzle orifices 11*a*. The amount of fuel to be injected may be adjusted depending on energizing time of the solenoid coil 12.

If the solenoid coil 12 is de-energized, the armature 13 may be moved downward by the spring force of the spring 13*f* so that the lower end surface 43 of the valve part 13*a* may be brought into contact with the seat portion 44 to close the outlet passage 24 of the control chamber 24. Since the high-pressure fuel is not drained from the control chamber 14 by the closing of the outlet passage 24, the fuel pressure in the control chamber 14 may be higher than that in the nozzle chamber 18. The difference between the fuel pressure in the nozzle chamber 18 and the fuel pressure in the control chamber 14 may generate a force to push the needle 15 downward, and the needle 15, together with the control rod 16, may be moved downward by the force. Accordingly, the needle 15 may close the nozzle orifices 11*a*. In this case, the sum of the fuel pressure in the control chamber 14 and the spring forces of the springs 13*f* and 15*a* may be greater than the fuel pressure in the nozzle chamber 18.

The fuel injector 10 according to an embodiment of the present disclosure may include an adjustment unit 50 for adjusting a fuel injection rate based on a load condition of an engine.

Figure 5:
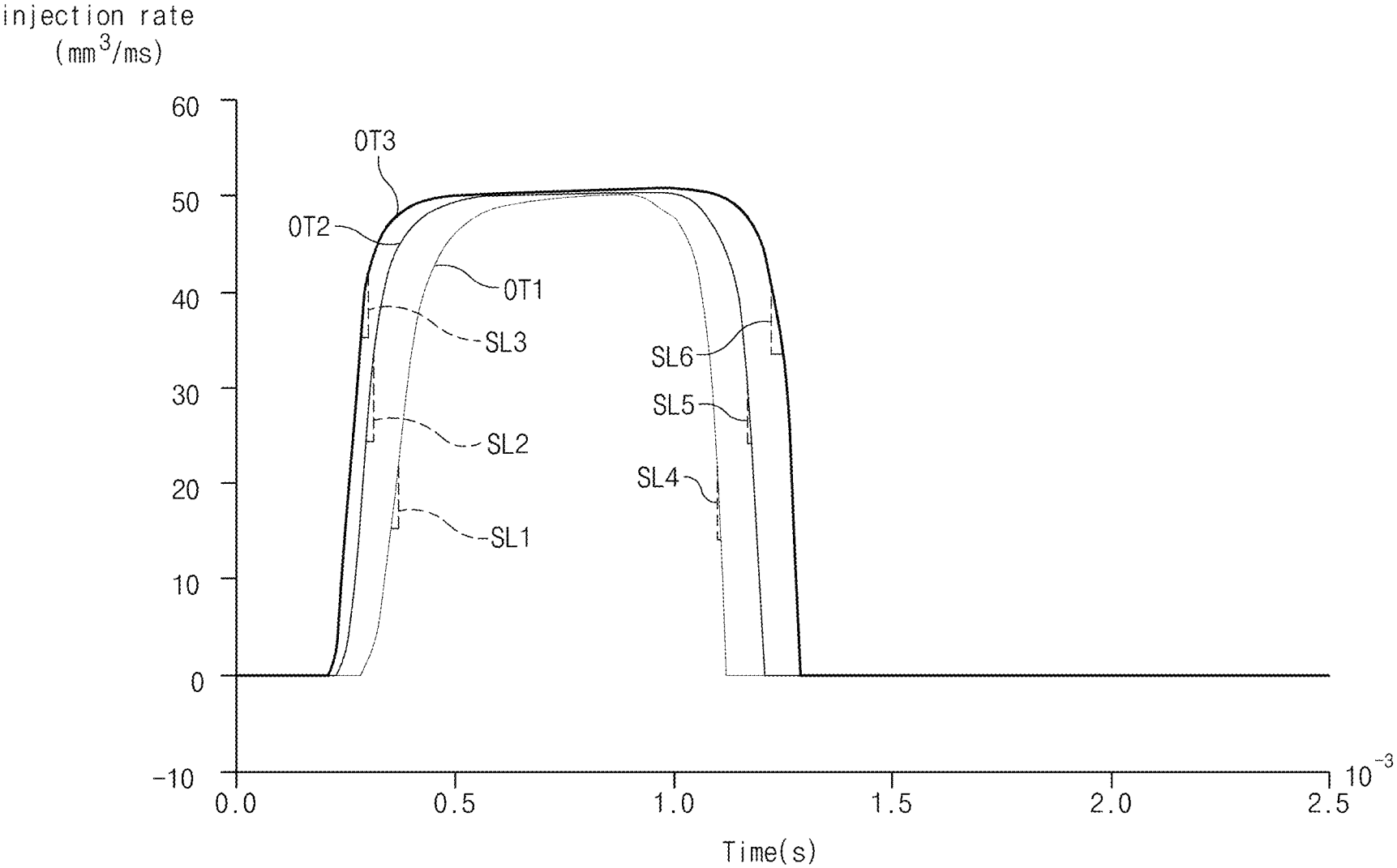
FIG. 5 is a graph depicting a fuel injection rate of the fuel injector according to time.

The adjustment unit 50 may be configured to adjust a fuel injection rate by adjusting the opening rate shape slope of the nozzle orifices 11*a*. Referring to FIG. 5, the opening rate shape slope of the nozzle orifices 11*a* (see SL1, SL2, and SL3 of FIG. 5) may be a fuel injection rate slope while the needle 15 is being completely moved from the closed position to the open position.

As illustrated in FIG. 5, as the opening rate shape slope of the nozzle orifices 11*a* increases (SL3>SL2>SL1), the nozzle orifices 11*a* may be more rapidly opened, and therefore an initial fuel injection rate and the amount of fuel to be injected may increase. Furthermore, as the opening rate shape slope of the nozzle orifices 11*a* decreases, the nozzle orifices 11*a* may be more slowly opened, and therefore an initial fuel injection rate and the amount of fuel to be injected may decrease.

According to an embodiment, the adjustment unit 50 may be configured to vary a reduction rate (variation) of the fuel pressure in the control chamber 14 by varying the amount of fuel drained from the control chamber 14 based on a load condition of an engine when the needle 15 opens the nozzle orifices 11*a*, and the opening rate shape slope of the nozzle orifices 11*a* may be adjusted by varying the reduction rate (variation) of the fuel pressure in the control chamber 14. That is, when the nozzle orifices 11*a* are opened, the adjustment unit 50 may adjust a reduction rate (variation) of the fuel pressure in the control chamber 14 to adjust the opening rate shape slope of the nozzle orifices 11*a* (see SL1, SL2, and SL3 of FIG. 5). Accordingly, the nozzle orifices 11*a* may be more rapidly or slowly opened, and thus the initial fuel injection rate and the amount of fuel to be injected may be adjusted.

According to an embodiment, the adjustment unit 50 may include a piezoelectric actuator 55 interposed between the solenoid coil 12 and the disk part 13*b* of the armature 13.

The piezoelectric actuator 55 may have a piezoelectric material. As illustrated in FIG. 2, the piezoelectric actuator 55 may contract to a minimum thickness of P1 if the piezoelectric actuator is de-energized. As illustrated in FIG. 3, the piezoelectric actuator 55 may expand to a thickness of P2 if the piezoelectric actuator 55 is energized. The expansion thickness P2 of the piezoelectric actuator 55 may be adjusted depending on the magnitude of applied input voltage.

The piezoelectric actuator 55 may have an insulation layer coated on an outer surface thereof, and the insulation layer may prevent electric interference, electromagnetic interference, and the like between the piezoelectric actuator 55 and the solenoid coil 12. An upper surface of the piezoelectric actuator 55 may be attached to the bottom of the solenoid coil 12.

An insulator 56 may be preferably interposed between the solenoid coil 12 and the piezoelectric actuator 55, and the insulator 56 may prevent electric interference, electromagnetic interference, and the like between the solenoid coil 12 and the piezoelectric actuator 55. The insulator 56 may be attached to the bottom of the solenoid coil 12, and the piezoelectric actuator 55 may be attached to the bottom of the insulator 56.

If the solenoid coil 12 is energized, as illustrated in FIG. 3, to open the nozzle orifices 11*a*, the armature 13 may move toward the solenoid coil 12, and the valve part 13*a* of the armature 13 may move upward so that the lower end surface 43 of the valve part 13*a* may be spaced apart from the seat portion 44 by an opening gap T1. The distance by which the armature 13 moves upward may be adjusted depending on the contraction thickness P1 and the expansion thickness P2 of the piezoelectric actuator 55, and therefore the opening gap T1 may be varied.

As described above, the opening gap T1 between the lower end surface 43 of the valve part 13*a* and the seat portion 44 may be adjusted to be greater or smaller than the fixed gap T2 of the outlet orifice 25 according to the contraction or expansion of the piezoelectric actuator 55. Accordingly, as the amount of high-pressure fuel drained from the control chamber 14 is varied, a variation in the fuel pressure in the control chamber 14 may be adjusted, and the opening rate shape slope of the nozzle orifices 11*a* (see SL1, SL2, and SL3 of FIG. 5) may be adjusted by the adjustment of the fuel pressure variation in the control chamber 14.

Meanwhile, not only the opening rate shape slope but also a closing rate shape slope may be adjusted as the opening gap T1 is adjusted according to the contraction or expansion of the piezoelectric actuator 55. This allows adjustment of the distance by which the needle 15 moves downward. Accordingly, the nozzle orifices 11*a* may be more rapidly or slowly closed, and thus a last fuel injection rate and the amount of fuel to be injected may be adjusted. Referring to FIG. 5, the closing rate shape slope of the nozzle orifices 11*a* (see SL4, SL5, and SL6 of FIG. 5) may be a fuel injection rate slope while the needle 15 is being completely moved from the open position to the closed position.

As illustrated in FIG. 5, as the closing rate shape slope of the nozzle orifices 11*a* increases (SL6>SL5>SL4), the nozzle orifices 11*a* may be more slowly closed, and therefore a last fuel injection rate may increase. Furthermore, as the closing rate shape slope of the nozzle orifices 11*a* decreases, the nozzle orifices 11*a* may be more rapidly closed, and therefore a last fuel injection rate may decrease.

For example, in FIG. 5, a line OT1 represents a state in which the opening gap T1 has been adjusted to be smaller than the fixed gap T2 of the outlet orifice 25 by the piezoelectric actuator 55. When the needle 15 opens the nozzle orifices 11*a* by energizing of the solenoid coil 12 in the state in which the opening gap T1 has been adjusted to be smaller than the fixed gap T2 of the outlet orifice 25, the armature 13 may move a short distance upward, which results in a reduction in the amount of high-pressure fuel drained from the control chamber 14. Accordingly, a reduction rate of the fuel pressure in the control chamber 14 may decrease (that is, the fuel pressure in the control chamber 14 may gradually decrease), and thus opening of the nozzle orifices 11*a* may be delayed. Since the opening of the nozzle orifices 11*a* is delayed, the opening rate shape slope SL1 of the nozzle orifices 11*a* may be relatively small. Furthermore, when the needle 15 closes the nozzle orifices 11*a* by de-energizing of the solenoid coil 12 in the state in which the opening gap T1 has been adjusted to be smaller than the fixed gap T2 of the outlet orifice 25, the armature 13 may move a relatively short distance downward, and thus the nozzle orifices 11*a* may be rapidly closed. Since the nozzle orifices 11*a* are rapidly closed, the closing rate shape slope SL4 of the nozzle orifices 11*a* may be relatively small. Since the nozzle orifices 11*a* are slowly opened and rapidly closed as described above, injection duration time may be short, which results in a reduction in the amount of fuel to be injected.

In FIG. 5, a line OT2 represents a state in which the opening gap T1 has been adjusted to be equal to or slightly greater than the fixed gap T2 of the outlet orifice 25 by the piezoelectric actuator 55. When the needle 15 opens the nozzle orifices 11*a* by energizing of the solenoid coil 12 in the state in which the opening gap T1 has been adjusted to be equal to or slightly greater than the fixed gap T2 of the outlet orifice 25, the distance by which the armature 13 moves upward may be longer than that in the case of the line OT1, which results in an increase in the amount of high-pressure fuel drained from the control chamber 14. Accordingly, a reduction rate of the fuel pressure in the control chamber 14 may increase (that is, the fuel pressure in the control chamber 14 may rapidly decrease), and thus the nozzle orifices 11*a* may be more rapidly opened in the case of the line OT2 than in the case of the line OT1. Since the nozzle orifices 11*a* are more rapidly opened, the opening rate shape slope SL2 of the nozzle orifices 11*a* may be greater than the operating rate shape slope SL1 of the line OT1. Furthermore, when the needle 15 closes the nozzle orifices 11*a* by de-energizing of the solenoid coil 12 in the state in which the opening gap T1 has been adjusted to be equal to or slightly greater than the fixed gap T2 of the outlet orifice 25, the armature 13 may move a relatively long distance downward, and thus the nozzle orifices 11*a* may be more slowly closed in the case of the line OT2 than in the case of the line OT1. Since the nozzle orifices 11*a* are more slowly closed, the closing rate shape slope SL5 of the nozzle orifices 11*a* may be greater than the closing rate shape slope SL4 of the line OT1. Since the nozzle orifices 11*a* are more rapidly opened and more slowly closed in the case of the line OT2 than in the case of the line OT1, injection duration time may be longer than that in the case of the line OT1, which results in an increase in the amount of fuel to be injected.

In FIG. 5, a line OT3 represents a state in which the opening gap T1 has been adjusted to be greater than the fixed gap T2 of the outlet orifice 25 by the piezoelectric actuator 55. When the needle 15 opens the nozzle orifices 11*a* by energizing of the solenoid coil 12 in the state in which the opening gap T1 has been adjusted to be greater than the fixed gap T2 of the outlet orifice 25, the distance by which the armature 13 moves upward may be longer than that in the case of the line OT2, which results in an increase in the amount of high-pressure fuel drained from the control chamber 14. Accordingly, a reduction rate of the fuel pressure in the control chamber 14 may be greater than that in the case of the line OT2 (that is, the fuel pressure in the control chamber 14 may rapidly decrease), and thus the nozzle orifices 11*a* may be more rapidly opened in the case of the line OT3 than in the case of the line OT2. Since the nozzle orifices 11*a* are more rapidly opened, the opening rate shape slope SL3 of the nozzle orifices 11*a* may be greater than the operating rate shape slope SL2 of the line OT2. Furthermore, when the needle 15 closes the nozzle orifices 11*a* by de-energizing of the solenoid coil 12 in the state in which the opening gap T1 has been adjusted to be greater than the fixed gap T2 of the outlet orifice 25, the armature 13 may move a relatively long distance downward, and thus the nozzle orifices 11*a* may be more slowly closed in the case of the line OT3 than in the case of the line OT2. Since the nozzle orifices 11*a* are more slowly closed, the closing rate shape slope SL6 of the nozzle orifices 11*a* may be greater than the closing rate shape slope SL5 of the line OT2. Since the nozzle orifices 11*a* are more rapidly opened and more slowly closed in the case of the line OT3 than in the case of the line OT2, injection duration time may be longer than that in the case of the line OT2, which results in an increase in the amount of fuel to be injected.

The solenoid coil 12 and the piezoelectric actuator 55 may be electrically connected to a controller 60, and the controller 60 may control energizing or de-energizing of the piezoelectric actuator 55, the magnitude of applied voltage, and the like, as well as controlling energizing or de-energizing of the solenoid coil 12, energizing time, and the like.

The controller 60 may receive position information of an accelerator pedal or a throttle pedal from an ECU of a vehicle to determine a full load condition (or full throttle condition) or a partial load condition (or partial throttle condition) of an engine.

In the case where the nozzle orifices 11*a* are open and the engine is under the full load condition, the controller 60 may de-energize the piezoelectric actuator 55 to maintain the thickness of the piezoelectric actuator 55 at the minimum thickness P1. Accordingly, the opening gap T1 may be greater than the fixed gap T2 of the outlet orifice 25, and thus an initial fuel injection rate and the amount of fuel to be injected may increase.

Since the piezoelectric actuator 55 contracts to the minimum thickness P1 under the full load condition of the engine and the opening gap T1 is greater than the fixed gap T2 of the outlet orifice 25, the amount of high-pressure fuel drained from the control chamber 14 may relatively increase. Accordingly, a reduction rate of the fuel pressure in the control chamber 14 may relatively increase (that is, the fuel pressure in the control chamber 14 may rapidly decrease), and thus the nozzle orifices 11*a* may be rapidly opened. That is, the opening rate shape slope of the nozzle orifices 11*a* may increase. As the opening rate shape slope of the nozzle orifices 11*a* increases, an initial fuel injection rate and the amount of fuel to be injected may increase, and thus output performance may be improved.

In the case where the nozzle orifices 11*a* are open and the engine is under the partial load condition, the controller 60 may energize the piezoelectric actuator 55 to expand the piezoelectric actuator 55 to the expansion thickness P2. At this time, the controller 60 may vary the expansion thickness P2 of the piezoelectric actuator 55 by controlling the magnitude of voltage applied to the piezoelectric actuator 55 according to the position of the accelerator pedal or the throttle pedal. Accordingly, the opening gap T1 may be smaller than or equal to the fixed gap T2 of the outlet orifice 25, and thus an initial fuel injection rate and the amount of fuel injected may decrease.

Since the expansion thickness P2 of the piezoelectric actuator 55 is adjusted depending on the magnitude of voltage under the partial load condition of the engine and the opening gap T1 is smaller than the fixed gap T2 of the outlet orifice 25, the amount of high-pressure fuel drained from the control chamber 14 may relatively decrease. Accordingly, a reduction rate of the fuel pressure in the control chamber 14 may decrease (that is, the fuel pressure in the control chamber 14 may slowly decrease), and thus the nozzle orifices 11*a* may be slowly opened. That is, the opening rate shape slope of the nozzle orifices 11*a* may decrease. As the opening rate shape slope of the nozzle orifices 11*a* decreases, an initial fuel injection rate and the amount of fuel to be injected may decrease. As a result, NOx may be reduced, and thus emission regulations may be assuredly satisfied.

Figure 6:
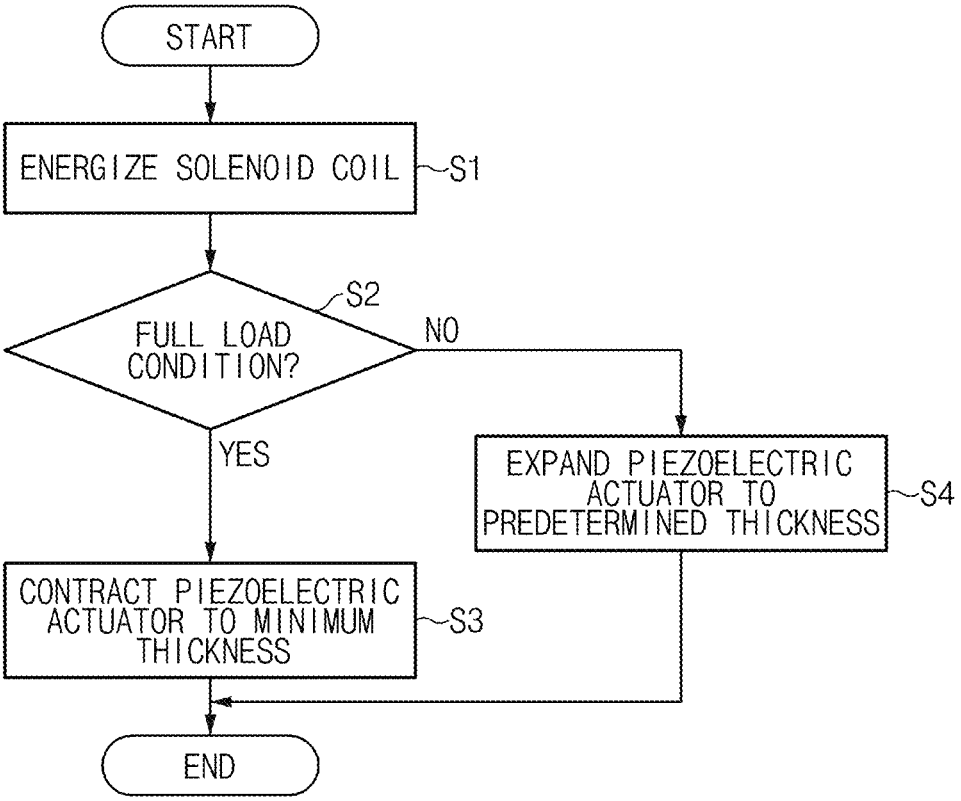
FIG. 6 is a flowchart illustrating a method of controlling a fuel injector according to an embodiment of the present disclosure.

FIG. 6 is a flowchart illustrating a method of controlling a fuel injector according to an embodiment of the present disclosure.

If an ECU for a vehicle sends a fuel injection signal to the controller 60, the controller 60 may energize the solenoid coil 12 (Step S1).

As the solenoid coil 12 is energized, the armature 13 may be attracted upward toward the solenoid coil 12 by electromagnetic force of the solenoid coil 12. The lower end surface 43 of the valve part 13*a* may be spaced apart from the seat portion 44 by the upward movement of the armature 13 to open the outlet passage 24 of the control chamber 14. High-pressure fuel may be drained from the control chamber 14 to the inner drain chamber 31 by the opening of the outlet passage 24, and the fuel pressure in the control chamber 14 may relatively decrease. Accordingly, the control rod 16 and the needle 15 may move upward, and therefore the nozzle orifices 11*a* of the injector body 11 may be opened to inject the high-pressure fuel through the nozzle orifices 11*a*. The amount of fuel to be injected may be adjusted depending on energizing time of the solenoid coil 12.

The controller 60 may receive position information of an accelerator pedal or a throttle pedal from the ECU of the vehicle to determine a full load condition or a partial load condition of an engine (Step S2).

If the engine is under the full load condition, the controller 60 may de-energize the piezoelectric actuator 55 to contract the piezoelectric actuator 55 to the minimum thickness P1 (Step S3). Accordingly, the opening gap T1 may be greater than the fixed gap T2 of the outlet orifice 25, and thus an initial fuel injection rate and the amount of fuel to be injected may increase. As described above, under the full load condition of the engine, the fuel injection rate and the amount of fuel to be injected may increase, and thus output performance may be improved.

If the engine is under the partial load condition, the controller 60 may energize the piezoelectric actuator 55 to expand the piezoelectric actuator 55 to a predetermined thickness (Step S4). At this time, the controller 60 may vary the expansion thickness P2 of the piezoelectric actuator 55 by controlling the magnitude of voltage applied to the piezoelectric actuator 55 according to the position of the accelerator pedal or the throttle pedal. Accordingly, the opening gap T1 may be smaller than or equal to the fixed gap T2 of the outlet orifice 25, and thus a fuel injection rate may decrease. As described above, under the partial load condition of the engine, the fuel injection rate and the amount of fuel to be injected may decrease, and thus NOx may be reduced. As a result, emission regulations may be satisfied.

Logical blocks, modules or units described in connection with embodiments disclosed herein can be implemented or performed by a computing device having at least one processor, at least one memory and at least one communication interface. The elements of a method, process, or algorithm described in connection with embodiments disclosed herein can be embodied directly in hardware, in a software module executed by at least one processor, or in a combination of the two. Computer-executable instructions for implementing a method, process, or algorithm described in connection with embodiments disclosed herein can be stored in a non-transitory computer readable storage medium.

Although the present disclosure has been described with reference to embodiments and the accompanying drawings, the present disclosure is not limited thereto, but may be variously modified and altered by those skilled in the art to which the present disclosure pertains without departing from the spirit and scope of the present disclosure.

Therefore, embodiments of the present disclosure are provided to explain the spirit and scope of the present disclosure, but not to limit them, so that the spirit and scope of the present disclosure is not limited by the embodiments. The scope of the present disclosure can be construed on the basis of the original claims, and all the technical ideas within the scope equivalent to the original claims are included in the scope of the present disclosure.

What is claimed is:

1. A fuel injector comprising:

an injector body having one or more nozzle orifices;

a solenoid coil mounted in the injector body;

a control chamber filled with high-pressure fuel;

an armature configured to be moved to vary fuel pressure in the control chamber;

a needle configured to move to open or close the one or more nozzle orifices according to the variation in the fuel pressure in the control chamber; and an adjustment unit configured to adjust a fuel injection rate by adjusting an opening speed of the nozzle orifices based on a load condition of an engine, wherein the adjustment unit includes an actuator interposed between the solenoid coil and the armature.

2. The fuel injector of claim 1, wherein the adjustment unit is configured to adjust the opening speed of the nozzle orifices by varying a variation rate of the fuel pressure in the control chamber based on the load condition of the engine when the needle opens the nozzle orifices.

3. The fuel injector of claim 1, wherein the adjustment unit is configured to adjust the opening speed of the nozzle orifices by adjusting the amount of fuel drained from the control chamber based on the load condition of the engine when the needle opens the nozzle orifices.

4. The fuel injector of claim 1, wherein the actuator contracts to a minimum thickness if the actuator is de-energized, wherein the actuator expands if the actuator is energized, and wherein a thickness by which the actuator expands is adjusted depending on the magnitude of applied input voltage.

5. The fuel injector of claim 1, wherein an insulation layer is coated on an outer surface of the actuator.

6. The fuel injector of claim 1, wherein an insulator is interposed between the solenoid coil and the actuator.

7. The fuel injector of claim 1, wherein the injector body has a high-pressure fuel passage communicating with the nozzle orifices, wherein a drain chamber is disposed between the solenoid coil and the control chamber, wherein the control chamber has an inlet passage communicating with the high-pressure fuel passage and an outlet passage communicating with the drain chamber, and wherein the armature has a valve part configured to open or close an opening of the outlet passage.

8. The fuel injector of claim 7, wherein a seat portion is formed around the opening of the outlet passage, and wherein a lower end surface of the valve part and the seat portion are spaced apart from, or brought into contact with, each other to open or close the outlet passage.

9. The fuel injector of claim 8, wherein the lower end surface of the valve part and the seat portion are spaced apart from each other by an opening gap when the armature moves upward, and wherein the opening gap is adjusted according to contraction or expansion of the actuator.

10. The fuel injector of claim 9, wherein the opening gap is adjusted to be greater or smaller than a fixed gap of an outlet orifice according to contraction or expansion of the actuator.

11. A method of controlling a fuel injector that includes an injector body having a nozzle orifice, a solenoid coil mounted in the injector body, a control chamber filled with high-pressure fuel and having an inlet passage through which the high-pressure fuel is introduced and an outlet passage through which the high-pressure fuel is drained, an outlet orifice formed in the outlet passage, an armature configured to be moved to vary fuel pressure in the control chamber, a needle configured to move to open or close the nozzle orifice according to the variation in the fuel pressure in the control chamber, and an actuator interposed between the solenoid coil and the armature, the method comprising:

contracting the actuator to a minimum thickness under a full load condition of an engine; and expanding the actuator to a predetermined expansion thickness under a partial load condition of the engine.

12. The method of claim 11, wherein an opening gap becomes larger than a fixed gap of the outlet orifice according to contraction of the actuator under the full load condition of the engine.

13. The method of claim 11, wherein an opening gap becomes smaller than or equal to a fixed gap of the outlet orifice according to expansion of the actuator under the partial load condition of the engine.

14. The method of claim 13, wherein a thickness by which the actuator expands is adjusted depending on the magnitude of applied voltage.

* * * * *